US005199699A

United States Patent [19]

Murad et al.

[11] Patent Number: 5,199,699

[45] Date of Patent: Apr. 6, 1993

[54] BASE HAVING ANTI-VIBRATION MEANS

[75] Inventors: George B. Murad, Buffalo Grove; Neil A. Polit, Crystal Lake, both of Ill.

[73] Assignee: Videojet Systems International, Inc., Wood Dale, Ill.

[21] Appl. No.: 853,103

[22] Filed: Mar. 18, 1992

[51] Int. Cl.[5] ..... B65H 3/24

[52] U.S. Cl. ..... 271/131; 271/132

[58] Field of Search ..... 271/131, 132, 144, 10–12, 271/99, 107; 74/589–591, 603, 604

[56] References Cited

U.S. PATENT DOCUMENTS

| | | | |
|---|---|---|---|
| 2,819,618 | 1/1958 | Slusher | 74/590 X |
| 3,173,682 | 3/1965 | Shields | 74/591 X |
| 4,121,222 | 10/1978 | Diebold et al. . | |
| 4,589,945 | 5/1986 | Polit . | |
| 4,630,812 | 12/1986 | Yano et al. | 271/132 |
| 4,800,852 | 1/1989 | Kandler | 74/604 X |

FOREIGN PATENT DOCUMENTS

| | | | |
|---|---|---|---|
| 3729920 | 3/1989 | Fed. Rep. of Germany | 271/131 |

OTHER PUBLICATIONS

A copy of a 1989 brochure of Cheshire, a Videojet Company, Wood Dale, Ill., entitled *Mailing Systems* "Helping you address for success".

A copy of a 1990 brochure of Cheshire, a Videojet Company, Wood Dale, Ill., entitled *Jetstream® II* "Versatility in ink jet imaging".

*Primary Examiner*—David H. Bollinger

*Attorney, Agent, or Firm*—Welsh & Katz, Ltd.

[57] ABSTRACT

A base for operative association with an operating mechanism sensitive to horizontal vibration, such as an ink jet printer, supports a horizontal document feeder plate and associated drive operative to advance documents in sequential fashion from a stack toward the operating mechanism. A drive linkage interconnects a rotatable drive shaft to the feeder plate to effect horizontal reciprocating movement thereof. A counterweight is associated with the drive so as to substantially offset or nullify horizontal inertia forces imparted to the base by the feeder plate whereby to minimize horizontal vibration of the base. In an embodiment utilized for intermittent feeding of documents to the operating mechanism, a balance arm and associated counterweight cooperate with the feeder plate to offset horizontal inertia forces imparted to the base, and also minimize start-up torque required to initiate reciprocating movement of the feeder plate after stoppage.

16 Claims, 2 Drawing Sheets

BASE HAVING ANTI-VIBRATION MEANS

BACKGROUND OF THE INVENTION

The present invention relates generally to a base for use with apparatus sensitive to horizontal vibration, and more particularly to a base that supports a generally horizontally reciprocating member and associated drive means normally operative to impart horizontal vibration to the base during operation, and includes novel means for substantially nullifying horizontal vibration forces imparted to the base by the reciprocating member.

It is a common practice in many types of apparatus and machines to connect an operating mechanism, such as a print head or the like, to a base so that the print head defines a work station at a desired height above the floor surface for convenient operation and operator comfort. The operating mechanism may be directly supported by the base, or may be freestanding but in operative association with the base. In those instances where the operating mechanism is sensitive to horizontal vibration, such as an ink jet printer mechanism, it is important that horizontal vibration of the base be minimized so as not to adversely interfere with proper printer operation. For example, ink jet printers project droplets of ink generally vertically downwardly onto a surface, such as a mailing envelope or other document, in a predetermined pattern to create a mailing address or other printed indicia. In commercial printing, the envelopes or other documents are generally fed in sequential one-at-a-time fashion along a horizontal path from a vertical stack of envelopes or documents to a position underlying the printer head by feeder means including a reciprocating shuttle or feeder plate. Drive means are cooperative with the shuttle plate to effect horizontal reciprocating movement thereof between a position operative to remove successive documents from the bottom of the stack and a position wherein the leading edge of each document enters a nip between feed rolls which advance the document onto transfer means for carrying the document to the printer head.

With apparatus or machines of the aforedescribed type, as the reciprocating shuttle plate reaches the end of each stroke, the momentum of the shuttle plate and the reaction force imparted to the base by reversal of the shuttle plate causes horizontal deflection of the base. This generally results in horizontal vibration of the printer head, if supported on the base, and thereby adversely effects proper operation of ink jet type printer mechanisms by significantly altering the print pattern. Proper operation of the ink jet printer mechanism is also adversely effected where the ink jet printer head is freestanding but overlies document transfer means supported on the base.

One solution to this problem is to make the base sufficiently heavy and rigid so that the forces imparted to the base by the reciprocating shuttle plate are resisted by the mere mass of the base, thus substantially nullifying horizontal vibration otherwise imparted to the printer head or to the document transfer means. This solution, however, is costly and results in a base substantially heavier than desired.

SUMMARY OF THE INVENTION

One of the primary objects of the present invention is to provide a novel drive mechanism for use with a reciprocating member supported on a base and wherein the drive mechanism is operative to nullify horizontal vibration forces imparted to the base by the reciprocating member.

A more particular object of the present invention is to provide a novel drive mechanism for use with a reciprocating shuttle plate supported on a base in a manner to facilitate horizontal feeding of articles along a predetermined path to a work station, such as an ink jet printer, the drive mechanism including a rotatable drive shaft disposed substantially transverse to the feed path and interconnected to the shuttle plate through linkage means operative to effect reciprocating movement of the shuttle plate during rotation of the drive shaft, and counterbalance means cooperative with the linkage means in a manner to offset horizontal force components otherwise imparted to the base during reciprocating movement of the shuttle date.

Another object of the present invention lies in providing a novel drive mechanism of the aforedescribed type wherein, in one embodiment, the drive shaft carries an eccentric or crank arm to which one end of a connecting rod is connected, the opposite end of the connecting rod being interconnected to the shuttle plate so as to effect a full cycle reciprocating movement of the shuttle plate during each revolution of the drive shaft, and wherein a counterbalance weight is carried by the crank arm in a manner to counterbalance and offset forces imparted to the base by the momentum of the shuttle plate as it reverses direction at the end of each stroke.

A feature of the feeder drive mechanism in accordance with another embodiment of the present invention lies in pivotally supporting a balance link intermediate its length on the base, connecting one end of the balance link to the horizontally reciprocating shuttle plate, and providing a counterbalance weight on the opposite end of the balance link so as to counterbalance and nullify horizontal vibration forces otherwise imparted to the base during reciprocating movement of the shuttle plate, and also minimize start/stop torque required to intermittently interrupt and re-start rotation of the drive shaft.

Further objects, features and advantages of the present invention, together with the organization and manner of operation thereof, will become apparent from the following description of the invention taken with the accompanying drawings wherein like reference numerals designate like elements throughout the several views.

DETAILED DESCRIPTION

Figure 1:
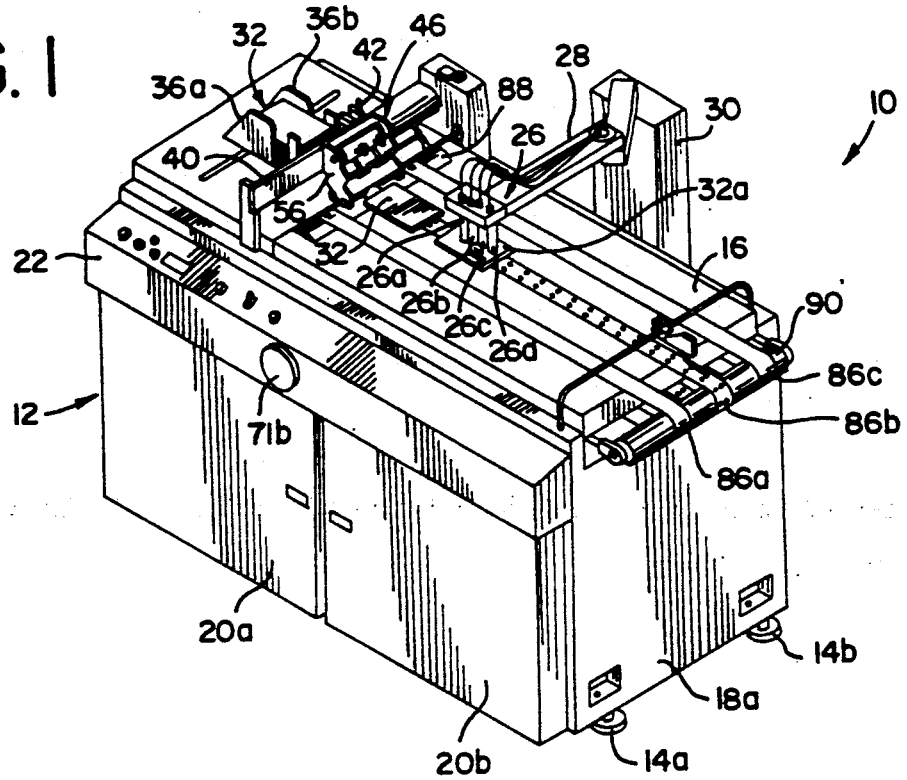
FIG. 1, is a perspective view of ink jet printer apparatus having a base and anti-vibration means in accordance with the present invention.

Referring now to the drawings, and in particular to FIG. 1, the present invention is illustrated, by way of example, in an ink jet printer apparatus indicated generally at 10. The ink jet printer apparatus 10 is of generally known design, such as commercially available from Videojet Systems International, Inc., Wood Dale, Ill., and includes a generally rectangular base 12 having adjustable corner support legs or pads, two of which are shown at 14*a* and 14*b*. The base 12 has a substantially horizontal upper support plate 16, vertical end walls 18*a* and 18*b*, and a pair of vertically hinged front doors 20*a* and 20*b* enabling access to the interior of the base. An elongated control panel 22 is supported along the upper front corner of the base 12 and supports various operating and control knobs and buttons as desired.

The base 12 is operatively associated with operating mechanism means in the form of an ink jet printer assembly 26 supported in predetermined position above the upper support plate 16. The ink jet printer assembly 26 is of known design, such as the Jetstream® II printer head available from Videojet Systems International, and defines a work station. In the illustrated embodiment, the ink jet printer assembly 26 includes four independent printheads 26*a–d* which are supported in cantilevered fashion by a substantially horizontal articulated support arm 28. The support arm 28 is in turn supported by an upstanding housing 30 connected to the base 12. Alternatively, the upstanding housing 30 may be freestanding and independent of the base 12 except for being positioned so that the printer assembly 26 overlies the upper support plate 16. The housing 30 may house various controls and ink supplies for the printheads 26*a–d* to enable controlled positioning and discharge of ink droplets from the printheads so as to place each droplet in a predetermined position on an underlying article, such as a mailing envelope, mailing label or other generally flat document indicated at 32*a*, fed or conveyed along a predetermined path on the support plate 16 to a position underlying the printer assembly. The printheads 26*a–d* may be controlled through a computer control (not shown) operative to create images, addresses, bar codes, graphic characters or other indicia on an underlying document, as is known. Conventional ink jet printheads discharge ink droplets through nozzle orifices so as to form one or more streams of minute droplets which impinge the underlying article or document in a controlled predetermined pattern. Ink jet printers are representative of apparatus which are particularly sensitive to horizontal vibration of either the apparatus or associated base. For example, relative movement between the printheads and an underlying document during a printing operation is particularly deleterious to proper printing.

Figure 3:
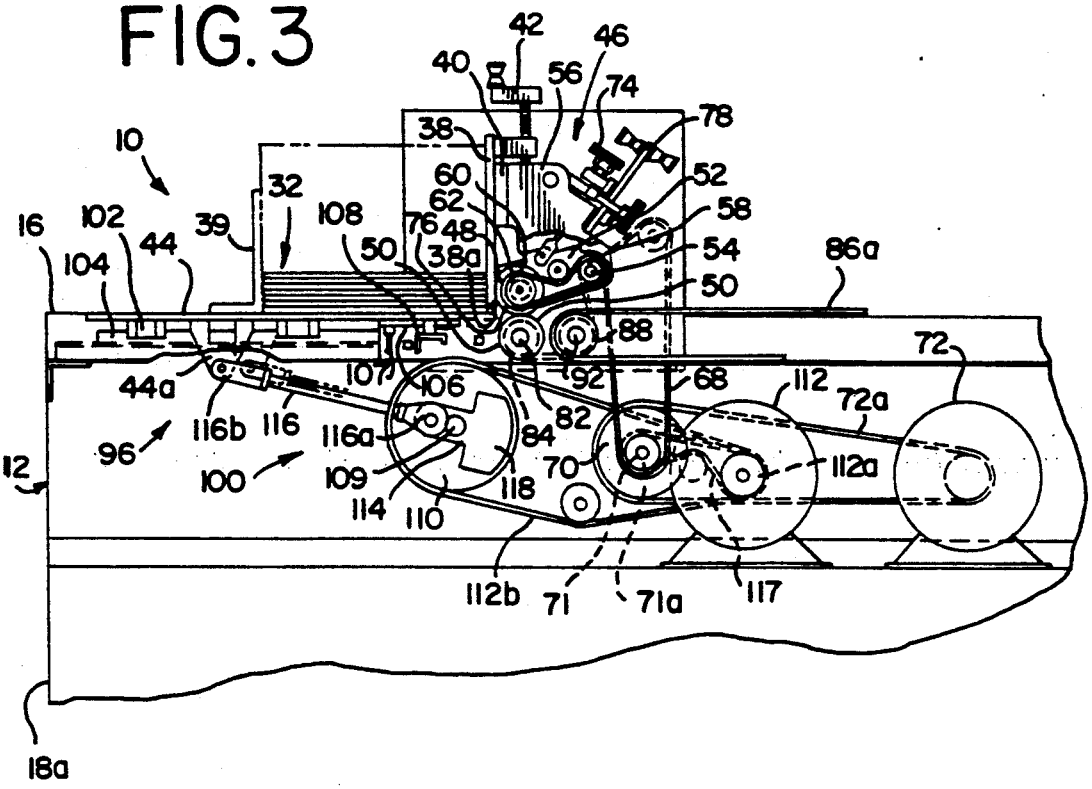
FIG. 3, is a front elevational view of the ink jet printer apparatus of FIG. 1 but having portions removed and portions broken away to better illustrate operating components within the base.

In the illustrated embodiment, the base 12 supports a plurality of generally flat documents 32, such as mailing envelopes or the like, in a vertical stack generally adjacent an infeed end of the upper support plate 16. The documents 32 are supported between upstanding laterally adjustable guide or stacker plates 36*a* and 36*b* (FIG. 1) such that forward or lead edges of the documents engage an upstanding gate member 38, as illustrated in FIG. 3. A rear backstop, such as indicated at 39 in FIG. 3, is preferably adjustable longitudinally of the support plate 16 to engage the rearward edges of the stack of documents 32. The gate member 38 is supported by a transverse horizontal support bracket or bar 40 for vertical adjustment through a hand screw or crank 42. A lower end 38*a* of the gate member 38 is thus adjustable relative to the upper surface of a shuttle plate 44 to enable only the bottom document 32 in the stack to pass beneath the gate member to a document feed or advancing station, indicated generally at 46, upon horizontal reciprocating movement of the shuttle plate, as will be described.

The document feed station 46 is of the type disclosed in U.S. patent application Ser. No. 07/791,036, filed Nov. 12, 1991, which is incorporated herein by reference. Briefly, the document feed station 46 includes at least one pair of mutually cooperable feed rolls in the form of upper and lower rotatably driven feed rolls 48 and 50, respectively. Preferably, the document feed station 46 includes a pair of laterally spaced upper feed rolls 48 each of which is rotatably carried by a separate support bracket 52 for cooperation with an underlying feed roll 50. Each support bracket 52 is pivotally supported on a transverse drive shaft 54 which in turn is rotatably supported by a frame 56 fixed to the transverse support bracket 40. The drive shaft 54 has a pair of laterally spaced drive pulleys fixed thereon, one of which is indicated at 58 in FIG. 3, which are interconnected through timing belts 60 to associated driven pulleys 62 fixed to the feed rolls 48.

The drive shaft 54 is driven through a timing belt 68 reeved about a suitable pulley (not shown) fixed on shaft 54. The timing belt 68 interconnects pulley shaft 54 in driving relation with a clutch/brake drive pulley 70 which is fixed on a transverse shaft 71 and connected through a suitable belt drive 72*a* to a drive motor 72 supported within the base 12. A fine adjustment or tuning knob 74 enables raising and lowering of the upper feed rolls 48 relative to their corresponding lower feed rolls 50 so as to vary the spacing or height of nips 76 between the upper and lower feed rolls in relation to the thickness of the documents 32 being fed to the ink jet printer assembly 26. Spring means (not shown) bias the upper feed rolls 48 toward their corresponding lower feed rolls 50. A pivotal lift lever 78 and associated toggle arm (not shown) enable manual raising and lowering of the upper drive rolls 48 in a fast-action movement to clear jams.

The lower pair of feed rolls 50 are fixed on a transverse drive shaft 82 rotatably supported by the base 12. A pulley 84 is also fixed on shaft 82 and is engaged by the timing belt 68 so as to rotate at substantially the same rotational speed as the upper feed rolls 48 but in an opposite direction. Thus, as the leading edge of each successive document 32 is caused to enter the nips 76, the upper and lower feed rolls engage the upper and lower surfaces of the document and accelerate it from the bottom of the stack onto one or more endless conveyor belts for transfer to the printer assembly work station 26. In the illustrated embodiment, three conveyor belts are supported by the base 12, as indicated at 86*a*, 86*b* and 86*c* in FIG. 1. The conveyor belts 86*a–c* are reeved over and extend between a driven transverse drive roll 88 (FIGS. 1 and 3) and a transverse idler roll 90 shown in FIG. 1. The drive roll 88 is fixed on a transverse shaft 92 which is supported by the base 12 and driven by the timer belt 68 to effect movement of the conveyor belts 86*a–c*. Depending on the lateral width of documents to be fed to the printer assembly 26, one or more of the conveyor belts 86*a–c* receive documents from the feed rolls 48 and 50 and transfer the documents in sequential spaced relation along a rectilinear path underlying the ink jet printer assembly 26. In the illustrated embodiment, the documents 32 are fed onto the center conveyor belt 86b which may have openings therethrough and pass over a suction box (not shown) so as to retain documents on the conveyor belt by suction.

The documents 32 are fed in sequential one-at-a-time order from the bottom of the stack into the nips 76 between the feed rolls 48 and 50 by feeder means, indicated generally at 96. The feeder means 96 includes the shuttle plate 44, alternatively termed a transfer member, which is supported for horizontal reciprocating movement, and shuttle drive means, indicated generally at 100. The drive means 100 is operative to effect selective reciprocating movement of the shuttle plate or transfer member 44 between a first or rearward position adapted to underlie the bottom document 32 in the stack, and a second or forward position operative to move the bottom document to a position wherein its leading edge enters the nips 76 and is engaged by the feed rolls 48 and 50 which advance the document onto the conveyor or transfer belts 86a–c.

Figure 2:
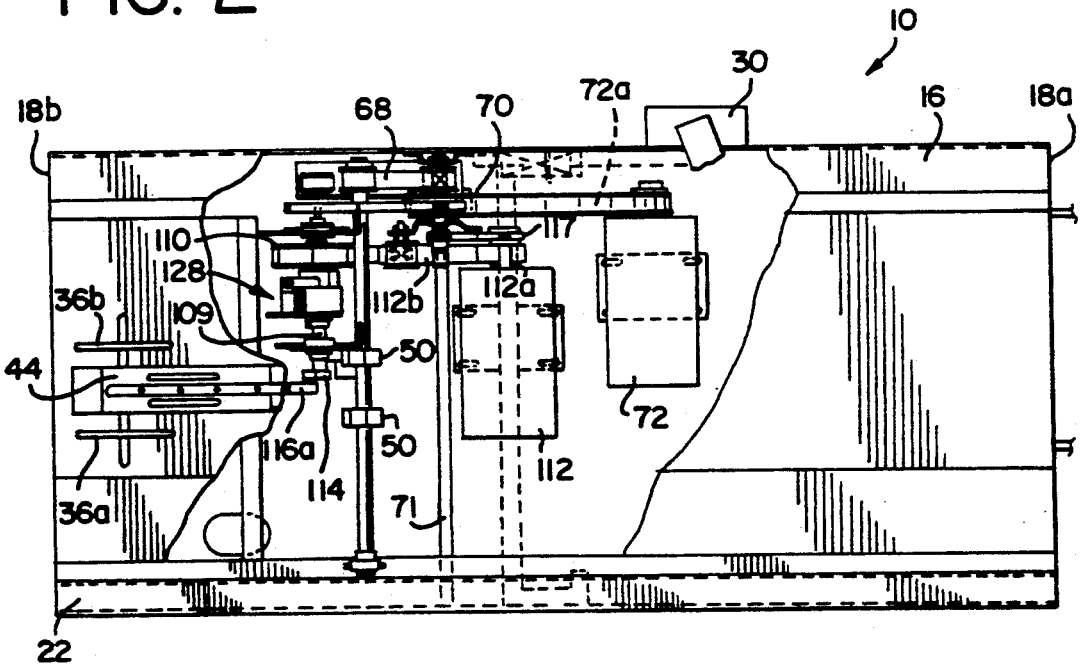
FIG. 2, is a fragmentary plan view of the printer apparatus of FIG. 1 but with portions removed to better illustrate components within the base support.

Referring to FIGS. 2 and 3, the shuttle or transfer member 44 comprises a generally rectangular shuttle plate which is supported on the base 12 for longitudinal reciprocating movement by suitable bearing and guide means. In the illustrated embodiment, linear bearings 102 are fixed to the bottom of the shuttle plate 44 and are moveable along a pair of parallel longitudinally extending guide tracks, one of which is indicated at 104 in FIG. 3. The shuttle plate is preferably supported so that its upper surface extends slightly above the upper surface of the upper support plate 16, such as about 1/16 inch, and has a feed stroke of approximately two inches.

In the illustrated embodiment, the shuttle plate 44 carries a vacuum plate assembly 106 at its forward end. The vacuum plate assembly 106 has a plurality of upwardly exposed suction or vacuum orifices (not shown) in its upper surface which are adapted for connection to a suction or vacuum hose 107 through a slide valve 108. The slide valve 108 is of known design and is operative to apply suction to the suction or vacuum orifices in the vacuum plate when the shuttle plate is in its rearward dead-center position so as to retain the bottom document 32 in the stack against the shuttle plate by suction. The slide valve 108 shuts off vacuum or suction to the vacuum orifices when the shuttle plate is in its forward end-of-stroke position to release the document into the nips 76.

The shuttle drive means 100 illustrated in FIG. 3 is particularly adapted for constant or continuous feeding of documents 32 from the document stack. To this end, the drive means 100 includes a transverse drive shaft 109 which is supported by the base 12 and has a drive pulley 110 fixed thereon. The pulley 110 is interconnected to an output pulley 112a of a suitable drive motor 112 through a drive belt 112b. The drive shaft 109, which may alternatively be termed a crankshaft, also has a crank arm 114 fixed thereon in a position generally underlying the longitudinal axis of the shuttle plate 44. A connecting rod 116 has one end pivotally connected to the crank arm 114 eccentric to the axis of crankshaft 109, as through crank pin means in the form of a crank pin 116a fixed to the crank arm 114 in normal relation thereto. The opposite end of the connecting rod 116 is pivotally connected at 116b to a bracket 44a fixed to the shuttle plate 44. In this manner, each rotation of the crankshaft 109 effects a full cycle reciprocating movement of the shuttle plate 44 between its first and second positions to feed documents one-at-a-time from the bottom of the stack of documents 32. Preferably, the drive shaft 109 and associated connecting rod 116 are positioned and configured such that the connecting rod is inclined downwardly at an angle of less than 45 degrees from horizontal when the shuttle or transfer plate 44 is in its rearward document pickup position.

If desired, the transverse shaft 71 may have a pulley 71a fixed thereon which is connected through a belt 117 to the drive pulley 112a on the drive motor 112. The shaft 71 is adapted for releasable engagement with a hand knob 71b mounted on the control panel 22 (FIG. 1) to enable an operator to manually operate the shuttle plate 44, feed rolls 48 and 50, and conveyor belts 86a–c during set-up.

With the shuttle plate feeder means 100 thus far described, it will be appreciated that the shuttle plate 44 undergoes a change in velocity from zero at its extreme end positions to a maximum velocity at its midpoint of travel. Correspondingly, acceleration of the shuttle plate during each stroke takes the form of a sine wave. As the shuttle plate 44 reaches the end of each stroke, the momentum or inertia of the shuttle plate and the connecting rod 116 imparts a force to the base 12 which has a substantially horizontal force component. The alternating momentum or inertia forces imparted to the base at the end of each stroke of the shuttle plate normally cause the base to undergo horizontal vibration which can adversely affect any mechanism supported directly on the base which is sensitive to horizontal vibration, such as the ink jet printer assembly 26, or any mechanism operatively associated with the base and which is sensitive to relative movement between the mechanism and the base caused, for example, by horizontal vibration of the base.

In accordance with one embodiment of the present invention, which finds particular application with the aforedescribed continuous feed drive arrangement for the shuttle plate 44, counterweight means in the form of a counterweight 118 is mounted on the crank arm 114 so as to oppose and offset the momentum or inertia forces imparted to the base 12 by the mass of the shuttle plate and connecting rod 116. The mass and center of gravity of the counterweight 118 are selected so that the counterweight offsets and substantially nullifies or minimizes horizontal vibration forces otherwise imparted to the base 12 by the shuttle plate 44 and shuttle plate drive components, such as the connecting rod 116.

Figure 4:
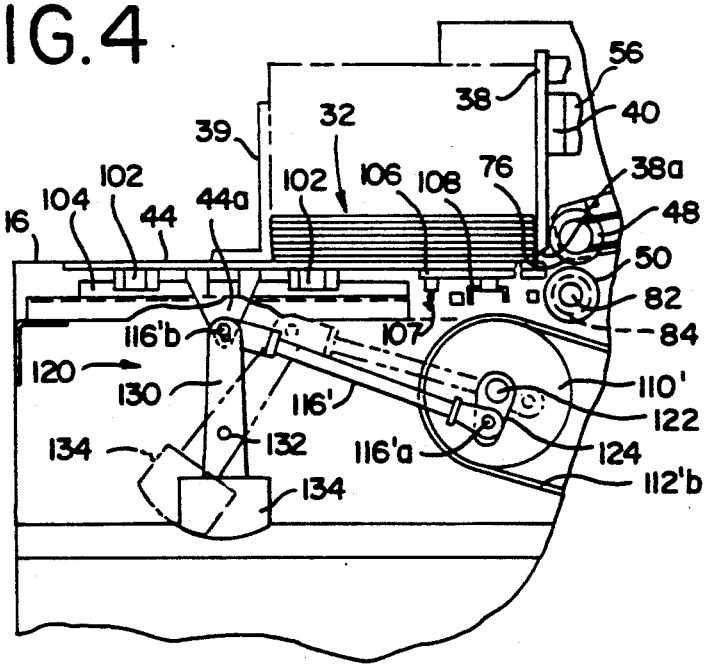
FIG. 4, is a fragmentary front view similar to FIG. 3 but illustrating an alternative embodiment of anti-vibration means for use with intermittent document feeder means.

FIG. 4 illustrates an alternative embodiment of feeder means, indicated generally at 120, for use with the shuttle plate 98 when it is desired to effect intermittent feeding of documents 32, rather than continuous or constant feeding, from the stack to the feed rolls 48 and 50 and then to the printer assembly 26. The feeder means 120, which may be termed a demand feeder arrangement, employs a transverse drive shaft or crankshaft 122 having a pulley 110' mounted thereon for driving connection to a drive motor, such as drive motor 112, through a drive belt 112'b. The crankshaft 122 has a crank arm 124 fixed thereon to which one end of a connecting rod 116' is pivotally connected eccentric to the rotational axis of crankshaft 122, as through crank pin means in the form of a crank pin 116'a fixed in normal relation to crank arm 124 eccentric to the axis of crankshaft 122. The opposite end of the connecting rod 116' is pivotally connected at 116'b to a bracket 44a fixed to the underside of the shuttle plate 44 so that rotation of the crank arm 124 effects reciprocating movement of the shuttle plate similar to the continuous feed drive means 100.

To enable intermittent or demand document feeding by the feeder means 120, a clutch/brake of known design, indicated generally at 128 in FIG. 2, is fastened to the drive shaft or crankshaft 122 between the drive pulley 110' and the crank arm 124. The clutch/brake 128 is controllable by control means (not shown) for manual actuation by an operator or for programmed control.

To minimize the braking torque required to stop the shuttle plate 44 in its rearward dead-center position, and to minimize start-up torque required to initiate or start movement of the shuttle plate toward the feed rolls 48 and 50 during a document feeding cycle, a counterbalance arm or link 130 is pivotally supported at its midpoint by a transverse pivot shaft 132 fixed to the base 12. The pivot shaft 132 is positioned to generally vertically underlie the pivot connection **116'*b* when the shuttle plate 44 is in its midpoint position, as shown in FIG. 4. An upper end of the counterbalance arm 130 is pivotally connected to the shuttle plate bracket 44*a* at the pivot axis 116'*b* through a sliding slot/pin connection to the pivot pin interconnecting the connecting rod 116' to the shuttle plate bracket. This sliding connection enables pivotal movement of the counterbalance arm or link 130 about its pivot axis 132** without binding at the shuttle plate.

A counterweight 134 is mounted on the end of the counterbalance arm 130 opposite its connection to the pivot axis **116'*b*. The mass of the counterweight 134 is selected to offset and minimize the net horizontal vibration forces acting on the base 12 due to the inertia or momentum of the shuttle plate 44, the connecting rod 116' and the crank arm 124 in all positions of the crank arm during a document feeding cycle. More particularly, the counterweight 134 substantially cancels or nullifies the inertia or momentum forces acting on the base from the shuttle plate, connecting rod and crank arm by imparting an equal and offsetting horizontal force to the base. Thus, the horizontal force components imparted to the base 12 by the shuttle plate 44, connecting rod 116' and crank arm 124 are substantially canceled or offset by the horizontal force components imparted to the base by counterbalance arm 130 and counterweight 134. The sliding connection of the counterbalance arm 130 to the shuttle plate bracket 44*a* eliminates vertical binding forces imparted to the base 12 by the counterbalance arm 130**.

By mounting or otherwise forming the counterweight 134 on the counterbalance arm or link 130 as described, the torque required to stop the drive shaft 122 and thereby the shuttle plate 44 when the shuttle plate is at its rear end dead-center (end of stroke) position is minimized because the inertia of the counterweight is substantially zero. Correspondingly, the acceleration curve of the counterweight during each stroke takes the form of a sine wave. Thus, the shuttle plate and counterweight undergo a soft start in attaining full acceleration, with a correspondingly reduced torque required by the clutch/brake 128 to initiate shuttle plate movement. In contrast, if the counterweight were located on the crank arm as illustrated in FIG. 3, the clutch/brake torque demand would be significantly increased on start-up because the counterweight 118 would require instant acceleration to full speed.

Summarizing, in accordance with the present invention a novel drive system is provided for use in effecting horizontal reciprocating movement of a member, and particularly a horizontally reciprocating shuttle plate or transfer member for feeding documents and the like to a work station operatively associated with a base and wherein the work station comprises mechanism sensitive to horizontal vibration. The various embodiments of the drive system in accordance with the invention substantially offset and nullify horizontal vibration inducing forces otherwise imparted to the base, either in constant or intermitted document feed systems. The intermittent drive system is particularly effective in minimizing start-up and braking torque requirements when the shuttle plate is in its rearward or document pickup position.

While preferred embodiments of the present invention have been illustrated and described, it will be understood that changes and modifications may be made therein without departing from the invention in its broader aspects. Various features of the invention are defined in the following claims.

What is claimed is:

1. Apparatus comprising, in combination, a base, operating means cooperative with said base to define a work station, said operating means being of the type sensitive to horizontal vibration of the base, document feeder means operative to support a stack of documents on said base, said feeder means including a transfer member moveable between a first position to receive a document from the stack and a second position to move the received document along a predetermined path toward the work station, drive means for effecting substantially horizontal reciprocating movement of said transfer member between said first and second positions, said drive means including a rotary drive shaft, and linkage means interconnecting said drive shaft to said transfer member so as to effect said reciprocating movement of said transfer member during rotation of said drive shaft, said linkage means including a crank arm mounted on said drive shaft for rotation therewith, a connecting rod having a first end pivotally connected to said crank arm eccentric to the axis of rotation of said drive shaft, and having a second end pivotally connected to said transfer member so that each rotation of said drive shaft effects a full cycle movement of said transfer member between its first and second positions, and counterbalance means including a counterbalance weight carried by said crank arm so as to create horizontal force components acting on the base which are substantially equal and opposite to any horizontal force components imparted to the base by said transfer member during reciprocating movement thereof.

2. Apparatus as defined in claim 1 wherein said drive shaft is disposed transverse to the direction of movement of said transfer member, said crank arm being fixed transverse to said drive shaft for rotation therewith, and crank pin means carried on said crank arm eccentric to its axis of rotation, said first end of said connecting rod being pivotally connected to said crank pin means.

3. Apparatus as defined in claim 2 wherein said drive shaft is supported by said base such that said connecting rod is inclined at an angle of less than 45 degrees from horizontal when said transfer member is in its said first position.

4. Apparatus as defined in claim 1 wherein said transfer member comprises a shuttle plate supported for horizontal reciprocating movement.

5. Apparatus as defined in claim 4 wherein said operating means includes an ink jet printer assembly defining said work station, and including transfer means operatively associated with said shuttle plate in a manner to transfer documents from said shuttle plate to a position underlying the printer assembly.

6. Apparatus as defined in claim 5 wherein said transfer means includes at least one pair of transfer rolls operative to remove documents from said shuttle plate when in said second position.

7. Apparatus as defined in claim 1 wherein said transfer member is supported by the base to underlie the stack of documents when in its said first position, said transfer member carrying vacuum means operative to releasably secure the bottom document in the stack to said transfer member when disposed in its said first position.

8. Apparatus comprising, in combination, a base, operating means cooperative with said base to define a work station, said operating means being of the type sensitive to horizontal vibration of the base, document feeder means operative to support a stack of documents on said base, said feeder means including a transfer member moveable between a first position to receive a document from the stack and a second position to move the received document along a predetermined path toward the work station, drive means for effecting substantially horizontal reciprocating movement of said transfer member between said first and second positions, said drive means including a rotary drive shaft, and linkage means interconnecting said drive shaft to said transfer member so as to effect said reciprocating movement of said transfer member during rotation of said drive shaft, said linkage means including a balance link pivotally supported generally intermediate its length, said balance link having a first end pivotally interconnected to said transfer member, said linkage means further including connecting rod means interconnecting said drive shaft to said transfer member such that rotation of said drive shaft effects said horizontal reciprocating movement of said transfer member, and counterbalance means including counterweight means carried by said balance link in a manner to offset horizontal forces imparted to the base by reciprocating movement of said transfer member whereby to minimize horizontal vibration forces acting on the base.

9. Apparatus as defined in claim 8 wherein said drive means includes a drive motor, and clutch/brake means interconnecting said drive motor to said drive shaft, said counterweight means being cooperative with said balance link to minimize the torque load required to initiate rotation of said drive shaft and effect reciprocating movement of said transfer member between its said first and second positions.

10. Apparatus as defined in claim 8 wherein said first end of said balance link is interconnected to said transfer member through a sliding connection so as to substantially prevent vertical force components from being imparted to said transfer member by said balance link during reciprocating movement of said transfer member.

11. Apparatus as defined in claim 8 wherein said balance link is supported for pivotal movement about a horizontal pivot axis substantially underlying said pivotal interconnection of said balance link to said transfer member when said transfer member is at its midstroke position.

12. Apparatus comprising, in combination, a base defining an elevated support surface, operating means cooperative with said support surface to define a work station, said operating means being of the type sensitive to horizontal vibration, article feeder means supported by said base for feeding articles to said work station, said feeder means including a transfer member moveable between a first position to receive an article thereon and a second position to move the article toward said work station, drive means for effecting substantially horizontal reciprocating movement of said transfer member between said first and second positions, said drive means including a rotary drive shaft, and linkage means interconnecting said drive shaft to said transfer member so as to effect said reciprocating movement thereof during rotation of said drive shaft, said linkage means including a crank arm mounted on said drive shaft for rotation therewith, a connecting rod interconnecting said crank arm to said transfer member so that rotation of said drive shaft effects movement of said transfer member between its first and second positions, and counterbalance means including a counterbalance weight carried by said crank arm so as to create horizontal force components acting on the base which are substantially equal and opposite to any horizontal force components imparted to the base by said transfer member during reciprocating movement thereof.

13. Apparatus as defined in claim 12 wherein said drive shaft is disposed transverse to the direction of movement of said transfer member, said crank arm is fixed transverse to said drive shaft for rotation therewith, and said connecting rod has a first end connected to said crank arm eccentric to its axis of rotation, and has a second end pivotally connected to said transfer member.

14. Apparatus as defined in claim 13 wherein said drive shaft is supported by said base such that said connecting rod is inclined at an angle of less than 45 degrees from horizontal when said transfer member is in its said first position.

15. Apparatus as defined in claim 12 including a balance link pivotally supported intermediate its length by said base, said balance link having a first end pivotally interconnected to said transfer member, and counterweight means carried by said balance link in a manner to substantially nullify any horizontal force components imparted to the base by said transfer member during reciprocating movement thereof.

16. Apparatus as defined in claim 15 wherein said balance link and counterweight cooperate with said transfer member to minimize the torque load required to initiate rotation of said drive shaft and effect reciprocating movement of the transfer member when disposed in said first and second positions.

* * * * *

UNITED STATES PATENT AND TRADEMARK OFFICE

CERTIFICATE OF CORRECTION

PATENT NO. : 5,199,699

DATED : April 6, 1993

INVENTOR(S) : George B. Murad and Neil A. Polit

It is certified that error appears in the above-identified patent and that said Letters Patent is hereby corrected as shown below:

Column 6, line 52, change "98" to --44--.

Column 7, line 55, change "inertia" to --velocity--.

Signed and Sealed this

Eighth Day of February, 1994

Bruce Lehman

*Attest:*

BRUCE LEHMAN

*Attesting Officer*

*Commissioner of Patents and Trademarks*